United States Patent [19]

Yeckley et al.

[11] 4,348,565

[45] Sep. 7, 1982

[54] INTERCHANGEABLE CHEMICALLY OPERATED CIRCUIT BREAKER

[75] Inventors: Russell N. Yeckley, Murrysville; Harvey E. Spindle, Wilkins Township, Allegheny County, both of Pa.

[73] Assignee: Westinghouse Electric Corp., Pittsburgh, Pa.

[21] Appl. No.: 171,700

[22] Filed: Jul. 24, 1980

[51] Int. Cl.[3] ..... H01H 33/28

[52] U.S. Cl. ..... 200/82 B; 200/148 R

[58] Field of Search ..... 200/148 R, 148 B, 82 B

[56] References Cited

U.S. PATENT DOCUMENTS 4,131,774 12/1978 Crookston et al. ..... 200/148 B 4,131,775 12/1978 Meyer et al. ..... 200/148 R

*Primary Examiner*—Robert S. Macon

*Attorney, Agent, or Firm*—M. S. Yatsko

[57] ABSTRACT

A circuit interrupter includes a pair of separable contacts, an operating mechanism for causing separation of the contacts, and a drive mechanism for causing movement of the operating mechanism. The drive mechanism includes a pressure generating propellant charge in communication with an operating cylinder which contains a piston and a piston rod, which piston rod is operatively connected to the operating mechanism. Either or both the propellant charge and the operating cylinder are preselected from a plurality of similar and interchangeable components which have different amounts of effective charge or cross-sectional interior areas respectively, to thereby modify the performance characteristics of the operating mechanism.

11 Claims, 5 Drawing Figures

INTERCHANGEABLE CHEMICALLY OPERATED CIRCUIT BREAKER

BACKGROUND OF THE INVENTION

This invention relates generally to electrical apparatus, and more particularly to a circuit breaker having a chemical operating mechanism with interchangeable, variable elements used to vary the performance characteristics of the breaker.

The use of chemical energy as a mechanism stored energy source has great potential for the operation of a wide variety of switching devices. Switching devices such as high speed grounding switches, current limiters, special purpose high speed closing switched for bypassing capacitors or reactor insertion and power circuit breakers present a wide range of energy levels. Future needs for these devices indicate energy requirements and operating times exceeding present available mechanism capabilities and which could be satisifed with chemical energy mechanisms.

Recent advances in power circuit breakers, and particularly the increasing use of commonly-referred to puffer-type circuit breakers, have resulted in increased demands on mechanism performance. Puffer circuit breakers require high energy levels because of the high moving masses and gas pressure forces required for interruption. The need for two cycle operating times, higher interrupting current and the move to higher voltage per break has further increased energy levels and demands for faster operations. Because of stored energy capability and the extremely short time for initiating the release of the stored energy, chemical energy devices are being looked upon increasingly favorably for application to the operation of puffer circuit breakers.

From a manufacturing standpoint, however, it is desirable to standardize as much as possible the various components used in manufacturing the wide range of circuit breakers which, for example, may include voltage ratings of from 121 KV through 800 KV with interrupting current capabilities of 40 and 50 KA. This desire for standardization and minimization of components is likewise desirable in the manufacture of the operating mechanism used for causing the separation of the main contacts of the circuit breaker. The provision of a low cost mechanism family for switching devices which utilizes only a small number of standard, interchangeable parts that can be produced in quantity, and which can give a varying energy range of a factor of, for example, 100 between the highest and lowest energies available, is desired.

SUMMARY OF THE INVENTION

In accordance with this invention, it has been found that a more desirable circuit interrupter is provided which comprises a pair of separable contacts, a movable operating mechanism connected to one of the separable contacts, and drive means for causing movement of the operating mechanism. The operating mechanism includes a movable drive rod which has a first end thereto, which end is connected to a piston rod which, in turn, is connected to a movable piston. The movable piston is disposed within a drive means cylinder which is in communication with pressure generating means. The pressure generating means generates a pressure within the drive means cylinder against the piston to cause movement thereof, causing movement of the piston rod and the drive rod connected thereto, resulting in movement of the separable contacts. In one embodiment of the invention, the drive means cylinder is preselected from a plurality of similar drive means cylinders, each of which has a different cross sectional interior area, so that the amount of pressure generated within the drive means cylinder against the piston can be preselected from a plurality of pressures. In a second embodiment of the invention, the pressure generating means includes a propellant charge for generating pressure within the drive means cylinder, and this propellant charge is preselected from a plurality of propellant charges each of which has a different effective charge so that the amount of pressure generated within the drive means cylinder against the piston can be preselected from a plurality of pressures.

BRIEF DESCRIPTION OF THE DRAWINGS

Reference is now made to the description of the preferred embodiment, illustrated in the accompanying drawings, in which.

DESCRIPTION OF THE PREFERRED EMBODIMENT

Figure 1:
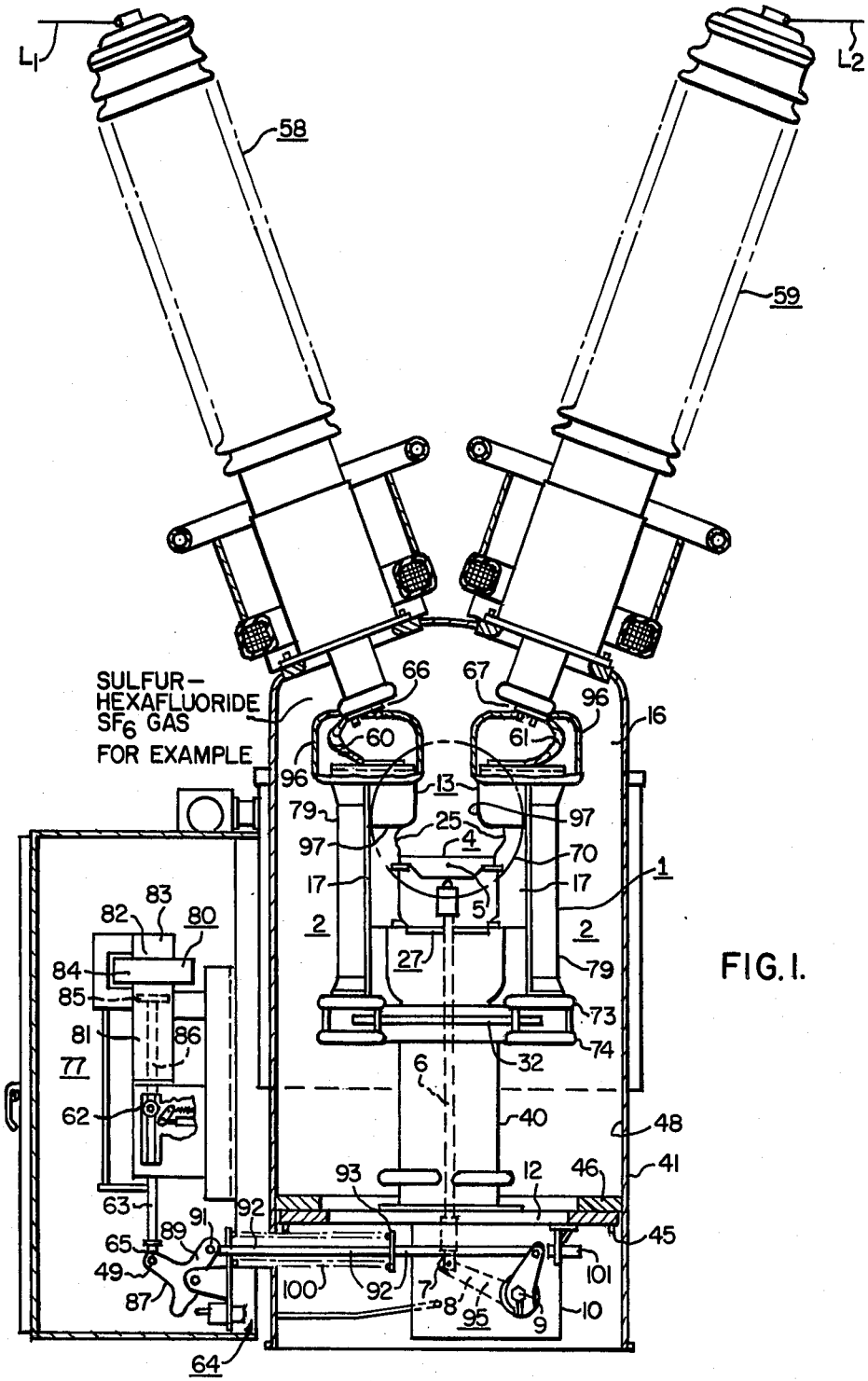
FIG. 1 is a vertical sectional view taken through a gas-insulated puffer circuit interrupter embodying the principles of the present invention.
Figure 2:
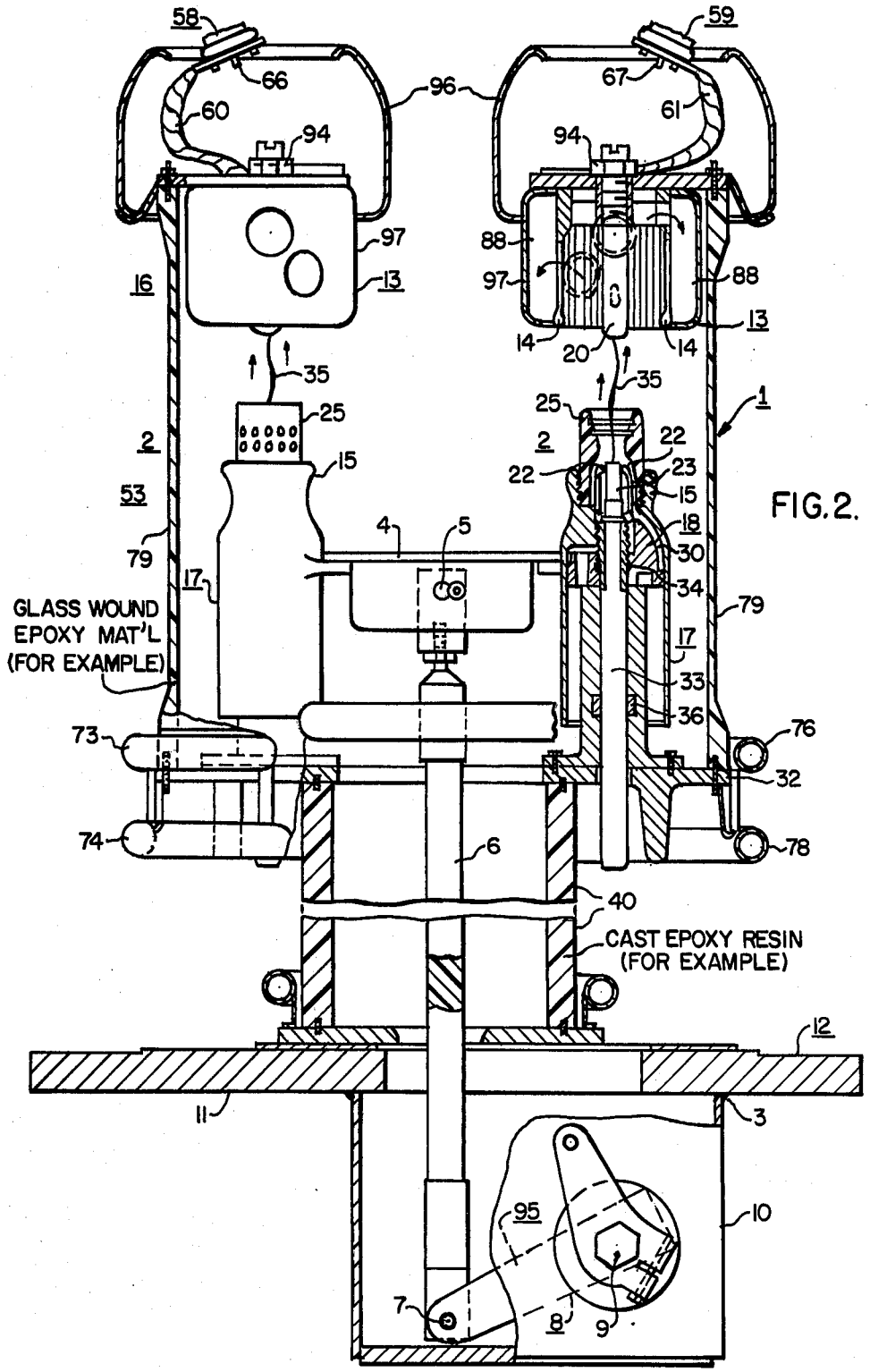
FIG. 2 is an enlarged vertical sectional view of the interrupting assembly utilized in the circuit breaker of FIG. 1.

Referring to the drawings, and more particularly to FIGS. 1–4 thereof, it will be observed that FIG. 2 illustrates a subassembly 1 comprising a pair of conjointly acting interrupter-modules 2 of the general type set forth in the U.S. Pat. Nos. 4,123,636 and 4,131,775, both assigned to the assignee of the instant patent application. As shown, the two interrupter modules 2 are electrically and mechanically tied together by a horizontally-extending bridging-bar construction 4 having pivotally connected thereto, as at 5, an upstanding main insulating operating rod 6.

The operating rod 6 is, as shown, pivotally connected at 7 to a bell-crank lever 8, which is affixed to a rotatable main operating shaft 9. A lever box 10 is affixed, as by welding 3 (FIG. 2), for example, to the lower surface 11 of the main metallic support-plate 12.

Each of the interrupter-modular units 2 comprises an upper relatively-stationary contact structure 13 including a cluster of annularly-arranged main stationary contact fingers 14, which, in the closed-circuit position of the interrupter, as indicated in FIG. 1, make good contacting engagement with an annular movable main contact 15 affixed to a gas compressing cylinder assembly 17, the latter moving downwardly during the opening operation over a relatively-fixed puffer piston structure 18.

Centrally disposed within the cluster of relatively-stationary main contact fingers 14 is a tubular stationary arcing contact 20, which makes engagement with a plurality of secondary movable arcing contact fingers 22, the movable arcing rod-shaped contact 23 extending therewithin.

Constituting a part of the movable operating-cylinder assembly 17 is an insulating hollow orifice 25, which directs the gas flow emanating from the compression space 30 (FIG. 4), interposed between the stationary puffer piston structure 18 and the outer-disposed movable cylinder 17. This gas flow strikes the established arc 35, as indicated in FIG. 2, and effects the rapid extinction thereof.

As will be obvious, the two modular interrupter units 2 operate simultaneously by their downward cooperative movement, and, in electrical series, constitute an electrical piece of interrupting equipment having a voltage rating of 242 KV with an interrupting capacity of 50 to 63,000 amperes, for example. The full-load continuous current rating of the circuit-interrupter, for example, would be 2,000 to 4,000 amperes.

As illustrated in FIG. 2, the two modular units 2 are collectively supported by an upstanding insulating support cylinder 40, which, in turn, is fixedly bolted to the relatively-heavy metallic support-plate 12, referred to hereinabove.

Following subassembly of the interrupting equipment 1, illustrated in FIG. 2, the grounded metallic tank structure 41 is lifted up and dropped over the subassembly, designated by the reference numeral 1. The heavy metallic support-plate 12 is secured by a plurality of circumferentially-disposed bolts 45 (FIG. 1) to the underside of a heavy mounting ring 46, which, in turn, is welded, for example, to the inner side walls 48 of the outer metallic tank structure 41.

The flexible connectors 60, 61, connected respectively to the upper stationary contact structures 13, may be manually secured to the lower terminal-studs 66, 67 of the two terminal-bushings 58, 59 by means of the manhole service opening 70 provided in the side wall of the tank structure 41. Thus, the major portion of the assembly operations may be conducted externally of the tank 41 with plenty of working space. Following the subassembly as mentioned, the tank 41 is dropped over the subassembly 1 to secure the two assemblies together. It will be noted that attached to the side of the metallic tank is the mechanism housing 75, together with its internally-located mechanism 77 (FIG. 1). Generally, this is of the type which, when operated, will effect opening of the circuit-breaker 53.

As can be seen in FIG. 1, the mechanism 77 is comprised of the drive means 80 which in turn is comprised of a drive means cylinder 81, a pressure cartridge 82 including therewith a propellant charge 83, and a reloader 84. The reloader 84 contains a multiplicity of pressure cartridges 82 so as to provide multiple operation of the drive means 80. The operating cylinder 81 has disposed therein a movable piston 85 to which is connected a movable piston rod 86. The piston rod 86 is secured to the first end 62 of the drive rod 63 which is part of the operating mechanism 64. The other end 65 of the drive rod 63 is pivotally connected as at 49 to a bell-crank lever 87.

A second arm 89 of the bell-crank lever 87 has pivotally connected thereto, as at 91, a connecting rod 92 having secured thereto a spring seat 93, which is biased toward the right, as viewed in FIG. 1, in a direction to close the circuit-breaker 53.

The connecting rod 92 is pivotally connected to the bell-crank lever assembly 95, which operates the main operating shaft 9. The construction is such that the compression spring 100 effects closing of the circuit-interrupter 53, a closing shock-absorber 101 (FIG. 1) being provided to limit the closing travel of the circuit-breaker 53.

Figure 3:
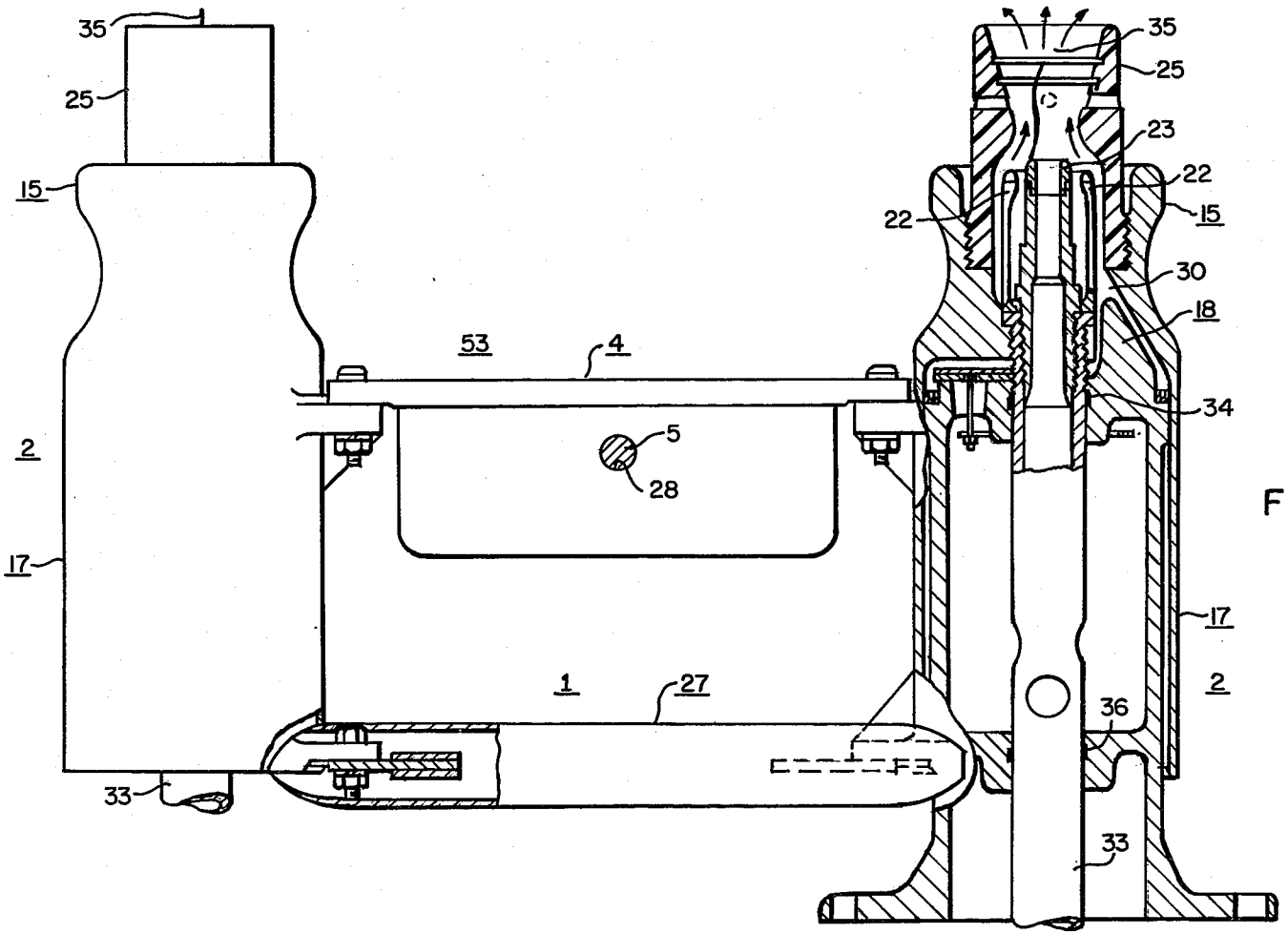
FIG. 3 is an enlarged, side elevational view of the two modular interrupting units arranged in electrical series, the left-hand modular unit being shown in side elevation, and the right-hand modular interrupting unit shown in vertical section.

FIG. 3 more clearly illustrates the electrical and mechanical interconnection between the two modular puffer units 2, including an upper generally U-shaped shielding cross-bar structure 4 and a lower-disposed similar U-shaped shielding structure 27.

Each of the movable operating cylinders 17 is guided by a steel rod 33, for example, slidable within guides 34 and 36 provided in the stationary puffer pistons 18, and serving to guide the movable operating cylinders 17 as they move to the open or closed circuit positions of the circuit-interrupter 53. The stationary puffer pistons 18 are mounted upon a central mounting plate 32 (FIG. 2) on which are also mounted electrostatic shielding ring-shields 73, 74, 76 and 78 for relieving the critical voltage regions and half-circle shaped support insulators 79, which support the upper terminals 66, 67, shields 96, 97 and arcing contacts 20 of the interrupter 53.

The main current passing through the circuit-interrupter 53 is transferred by means of finger clusters 14, for example, which mount upon the upper stationary contact terminal 13, and transfers current to the annular outside main movable contact 15 of each movable puffer, or operating cylinder 17. Secondary contacts 22 are provided inside of each moving operating cylinder 17 to handle the arc 35 during circuit-interruption.

Two electrostatic shields 96, 97 mount upon the top stationary contact terminals 13. The lower shield 97 acts as a voltage shield and also deflects much of the hot, ionized gas, created during interruption, into regions 88 in the breaker 53 having relatively low-voltage stress and a large gas volume to mix with the hot gas 16. The upper shield 96 hides the top terminal bolts 94 and the shunts 60, 61, which are connected in the final assembly to the breaker entrance bushings 58, 59. The top terminal 13 and shield arrangement 96, 97 is independent of the type of bushing 58, 59 which is used on the complete circuit-breaker 53. The breaker 53 may thus be used in free-standing or gas-insulated substation applications.

The central mounting plate 32 is a cast aluminum member, for example, shaped to provide high mechanical strength and support for the piston pressure loading during breaker operation and to provide electrical shielding of the electrically poorly-shaped guide rods 33 and main insulating tube mounting bolts.

The side vertical support-plates 79 are important, inasmuch as they must have the requisite strength for supporting the upper-disposed relatively-stationary contact assemblies 13. Additionally, these vertical side-support plates 79 have an additional function of keeping the arc and hot arcing products away from the side-walls 48 of the outer grounded metallic tank 41. Of the utmost importance, however, is the fact that the side-insulating support-plates 79 support the upper stationary contact structures 13, so that the upper terminal members are completely supported independently from the terminal-bushings 58, 59, when the latter are used. As a result, the stationary contact structures 13 may merely be electrically connected by a flexible conductor 60, 61 to the lower, interior ends of the terminal-studs 66, 67 of the terminal-bushings 58, 59 when they are used; and when they are not used, electrical connection may, alternatively, be made to the interior live conductors of gas-insulated transmission-line equipment.

By utilizing the side-support plates 79, there is no necessity for having any supporting cross-member (not shown) between the two laterally-spaced stationary contact structures 13. This has the advantage that there are no surface creepages, which would be encountered, and advantage is taken of the high insulating qualities of the sulfur-hexafluoride ($SF_6$) gas 16 disposed within the outer tank structure 41.

An additional advantageous result of the foregoing arrangement is that it allows the interrupter assembly 1, which is completely supported from the lower, relatively-heavy base 12, to be built-up as a bench unit-assembly 1, that can be actually completely tested, adjusted and subsequently put into a surrounding circuit-breaker tank 41.

The insulating half-shields 79 are fabricated of a glass-wound epoxy material, for example, having embedded mounting studs therein at the upper and lower ends. The gas flow is, consequently, directed into regions within the circuit-breaker tank 41, where it encounters relatively cool un-ionized gas.

The operation of the circuit interrupter illustrated in FIGS. 1–4 is as follows. Upon the occurrence of an activating signal, the propellant charge 83 within the pressure cartridge 82 is ignited, burning the propellant in a confined, small volume developing thousands of pounds of pressure within the drive means cylinder 81 with which the propellant charge 83 is in full communication. This pressure within the drive means cylinder 81 acts against the piston 85 within the drive means cylinder 81, causing both the piston 85 and the piston rod 86 connected therewith to move downward as illustrated in the drawings. This downward movement of the piston rod 86 causes a corresponding downward movement of the drive rod 63 to which it is connected. Downward movement of the drive rod 63 causes, through the pivotal connection at 49 with the bell-crank lever 87, a counterclockwise rotational movement of the bell-crank lever 87. This rotational movement of the bell-crank lever 87 causes a corresponding leftward movement of the connecting rod 92, which in turn results in a counterclockwise movement of bell-crank lever assembly 95, causing a rotation of the drive shaft 9 and a corresponding counterclockwise rotation of the lever 8. Counterclockwise rotation of the lever 8 causes a downward motion of the operating rod 6 to which it is connected, and the downward movement of the operating rod 6 causes a downward motion of the bridging-bar construction 4 which, in turn, is connected to the movable contacts 15, 22. Downward movement of the movable contacts 15, 22 causes them to separate from the stationary contacts 14, 20, and interruption of the current then proceeds as was described in the above-referenced patents.

Figure 5:
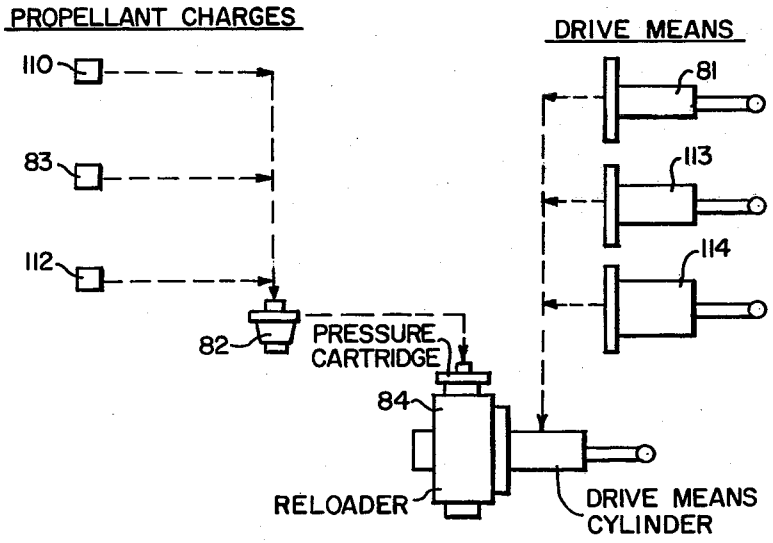
FIG. 5 is a schematic diagram illustrating the interchangeability of the propellant charges and cylinders utilized in the drive means.
Figure 4:
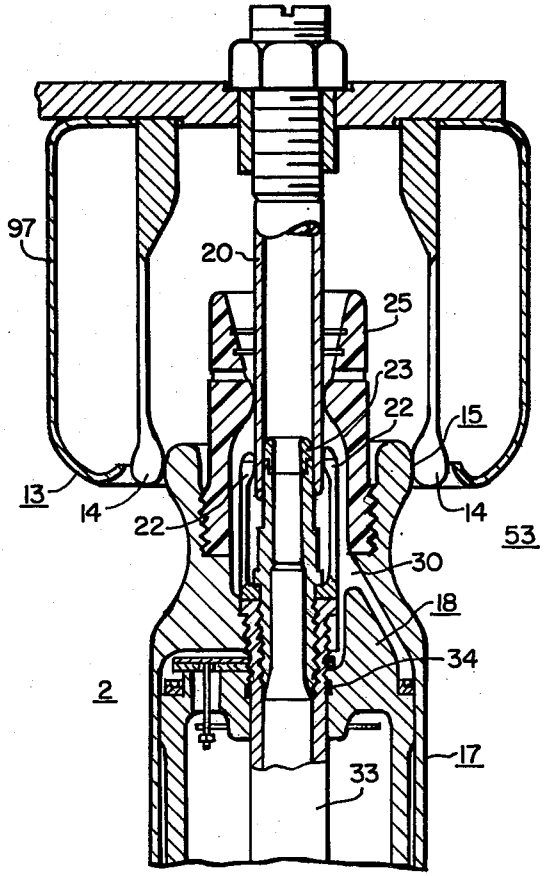
FIG. 4 is a vertical sectional view taken through the stationary and movable contact structures in the closed-circuit position of the interrupter.

It will be noted that this invention results in one basic mechanism design that, with minor, interchangeable modifications, is suitable for application to the complete range of circuit breakers in the voltage range 121–800 KV. As illustrated in FIG. 5, the drive means 80 includes two components, the propellant charge and the drive means cylinder, which are preselected to result in the desired speed and force characteristics which are required. As can be appreciated from FIG. 5, the propellant charge 83 which is inserted within the pressure cartridge 82, is preselected from a plurality of propellant charges 110, 83, 112, each of which has a different effective charge. For example, the range of effective charges between the propellant charge 110 having the lowest effective charge to the propellant charge 112 having the highest effective charge, may vary by ratio of, for example, 10:1. Because the propellant charge is preselected from a range of available effective propellant charges, the amount of pressure which can be generated within the drive means cylinder 81 can be varied by the simple expedient of selecting a particular charge from among a set of standardized interchangeable charges. This results in a more-effective manufacturing operation, as only one component—the propellant charge—need be manufactured containing different effective charges to produce a mechanism for causing separation of the circuit breaker contacts having differing performance characteristics.

In a similar fashion, the drive means cylinder 81 is preselected from a plurality of drive means cylinders 81, 113, 114, each of which has a different cross-sectional interior area and a correspondingly sized piston 85. For example, the ratio of cylinder cross-sectional area from the drive means cylinder 81 having the highest cross-sectional area to the cylinder 114 having the lowest cross-sectional area may vary by a ratio of 10:1 (that is, their interior diameters may vary by a ratio of about 3:1), thus resulting in differing areas through which the pressure generated by the pressure generating means is working. Because of these different areas, the quantity of pressure exerted against the drive means piston 85 is varied, which results in differing performance characteristics for the circuit breaker. This varying of the performance characteristics is accomplished utilizing only the change involved in selecting one drive means cylinder 81 from the plurality of drive means cylinders 81, 113, 114 available, with the cylinders all being standardized in that they are capable of being connected to both the reloader 84 and the drive rod end 62. Thus, a wide variety of performance characteristics is achievable utilizing the interchangeability of only one component.

To achieve even greater versatility, both the propellant charge 83 and the drive means cylinder 81 can be preselected and matched to the desired performance characteristics. Utilizing the figures given above, it can be seen that a total energy range of 100:1 can be achieved by varying both the propellant charges and drive means cylinders from the highest to lowest charges and areas respectively.

Although the drive means herein is illustrated as being of the chemically-opened, spring-closed type, the invention is not so limited and may be used additionally in spring-open, chemically-closed and chemically open and close mechanisms. Indeed, if utilized in a chemically opened and closed mechanism, the selection of the appropriate drive means cylinder and propellant charge for the two operations can be made independently of each other so as to tailor the operating characteristics to the energy requirements of each particular operation.

Thus, it can be seen that the above-described invention discloses a circuit breaker and operating mechanism which will operate at a wide variety of performance levels utilizing the interchangeability of only two components of the operating mechanism and drive means.

What is claimed is:

1. A circuit interrupter comprising:
a pair of separable contacts;
a movable operating mechanism connected to one of said separable contacts to cause movement thereof, said operating mechanism including a movable drive rod having a first end thereto; and
drive means for causing movement of said operating mechanism connected to said drive rod first end, said drive means comprising:
a reloader;
a drive means cylinder secured to said reloader and having disposed therein a movable piston and a piston rod secured to said piston, said piston rod extending outwardly of said drive means cylinder and being secured to said drive rod first end; and
pressure generating means in communication with the interior of said drive means cylinder, said pressure generating means generating a pressure within said drive means cylinder against said piston to cause movement thereof;
said drive means cylinder being preselected from a plurality of drive means cylinders each having a different cross-sectional interior area such that the amount of pressure generated within said drive means cylinder against said piston can be preselected from a plurality of pressures, each of said plurality of drive means cylinders capable of being secured to said reloader and said drive rod first end the same as each other of said plurality of drive means cylinders.

2. The circuit interrupter according to claim 1 wherein said pressure generating means includes a propellant charge for generating pressure preselected from a plurality of propellant charges each having a different effective charge such that the amount of pressure generated within said drive means cylinder against said piston can be preselected from a plurality of pressures.

3. The circuit interrupter according to claim 2 wherein said plurality of effective charges vary by a ratio of 10:1 from the highest effective charge to the lowest effective charge.

4. The circuit interrupter according to claim 1 wherein said plurality of drive means cylinder cross-sectional interior areas vary by a ratio of 10:1 from the highest to the lowest cross-sectional interior area.

5. A circuit interrupter comprising:
a pair of separable contacts;
a movable operating mechanism connected to one of said separable contacts to cause movement thereof, said operating mechanism including a movable drive rod having a first end thereto; and
drive means for causing movement of said operating mechanism connected to said drive rod first end, said drive means comprising:
a reloader having a multiplicity of pressure cartridges contained therein;
a drive means cylinder secured to said reloader and having disposed therein a movable piston and a piston rod secured to said piston, said piston rod extending outwardly of said drive means cylinder and being secured to said drive rod first end; and
pressure generating means including a propellant charge disposed in each of said pressure cartridges, only one of said pressure cartridges and propellant charges being in communication with the interior of said drive means cylinder at a time, said pressure generating means generating a pressure within said drive means cylinder against said piston to cause movement thereof;
each of said propellant charges having the same effective charge and being preselected from a plurality of sets of propellant charges, each set of propellant charges having a different effective charge such that the amount of pressure generated by each propellant charge in a set of propellant charges within said drive means cylinder against said piston can be preselected from a plurality of pressures.

6. The circuit interrupter according to claim 5 wherein said plurality of effective charges vary by a ratio of 10:1 from the highest effective charge to the lowest effective charge.

7. A drive mechanism capable of operating any of a plurality of circuit interrupters having a voltage rating from 121 through 800 Kv each having a desired performance characteristic, each circuit interrupter comprising a pair of contacts and a movable operating mechanism connected to one of said separable contacts to cause movement thereof, said operating mechanism including a movable drive rod having a first end thereto, said drive mechanism causing movement of said operating mechanism and comprising:
a reloader having a pressure cartridge contained therein;
a drive mechanism cylinder secured to said reloader and having disposed therein a movable piston and a piston rod secured to said piston, said piston rod extending outwardly of said drive mechanism cylinder and being secured to said drive rod first end; and
pressure generating means including a propellant charge disposed in said pressure cartridge and in communication with the interior of said drive mechanism cylinder, said pressure generating means generating a pressure within said drive mechanism cylinder against said piston to cause movement thereof;
said drive mechanism cylinder being preselected from a plurality of drive mechanism cylinders each having a different cross-sectional interior area such that the amount of pressure generated within said drive mechanism cylinder against said piston can be preselected from a plurality of pressures to obtain the performance characteristic desired for the circuit interrupter operated by said drive mechanism, each of said plurality of drive mechanism cylinders capable of being secured to said reloader and said drive rod first end the same as each other of said plurality of drive mechanism cylinders.

8. The drive mechanism according to claim 7 wherein said propellant charge is preselected from a plurality of propellant charges each having a different effective charge such that the amount of pressure generated by said propellant charge within said drive mechanism cylinder against said piston can be preselected from a plurality of pressures to obtain the performance characteristic desired for the circuit interrupter operated by said drive mechanism, each of said plurality of propellant charges capable of being disposed in said pressure cartridge.

9. A drive mechanism capable of operating any of a plurality of circuit interrupters having a voltage rating from 121 through 800 Kv each having a desired performance characteristic, each circuit interrupter comprising a pair of separable contacts and a movable operating mechanism connected to one of said separable contacts to cause movement thereof, said operating mechanism including a movable drive rod having a first end thereto, said drive mechanism causing movement of said operating mechanism and comprising:

a reloader having a pressure cartridge contained therein;

a drive mechanism cylinder secured to said reloader and having disposed therein a movable piston and a piston rod secured to said piston, said piston rod extending outwardly of said drive mechanism cylinder and being secured to said drive rod first end; and pressure generating means including a propellant charge disposed in said pressure cartridge and in communication with the interior of said drive mechanism cylinder, said pressure generating means generating a pressure within said drive mechanism cylinder against said piston to cause movement thereof;

said propellant charge being preselected from a plurality of propellant charges each having a different effective charge such that the amount of pressure generated by said propellant charge within said drive mechanism cylinder against said piston can be preselected from a plurality of pressures to obtain the performance characteristic desired for the circuit interrupter operated by said drive mechanism, each of said plurality of propellant charges capable of being disposed in said pressure cartridge.

10. The drive mechanism according to claims 7 or 8 wherein said plurality of drive mechanism cylinder cross-sectional interior areas vary by a ratio of 10:1 from the highest to the lowest cross-sectional interior area.

11. The drive mechanism according to claims 8 or 9 wherein said plurality of effective charges vary by a ratio of 10:1 from the highest effective charge to the lowest effective charge.

* * * * *